US005657661A

United States Patent [19]

Muschalik

[11] Patent Number: 5,657,661

[45] Date of Patent: Aug. 19, 1997

[54] WORKING METHOD FOR LOADING AN EXTRUSION BILLET AND METAL EXTRUSION PRESS

[75] Inventor: Uwe Muschalik, Duisberg, Germany

[73] Assignee: Mannesmann Aktiengesellschaft, Dusseldorf, Germany

[21] Appl. No.: 464,770

[22] PCT Filed: Oct. 14, 1993

[86] PCT No.: PCT/DE93/00994

§ 371 Date: Aug. 31, 1995

§ 102(e) Date: Aug. 31, 1995

[87] PCT Pub. No.: WO94/14550

PCT Pub. Date: Jul. 7, 1994

[30] Foreign Application Priority Data

Dec. 22, 1992 [DE] Germany ..... 42 44 261.3

[51] Int. Cl.[6] ..... B21C 33/00

[52] U.S. Cl. ..... 72/270; 72/272; 72/263

[58] Field of Search ..... 72/263, 270, 272, 72/273

[56] References Cited

U.S. PATENT DOCUMENTS

| | | | |
|---|---|---|---|
| 2,429,525 | 10/1947 | Rawlinson et al. | 72/270 |
| 3,416,349 | 12/1968 | Kent et al. | 72/270 |
| 3,592,032 | 7/1971 | Stromblad | 72/270 |
| 3,818,745 | 6/1974 | Pollack et al. | 72/270 |
| 4,326,399 | 4/1982 | Doudet | 72/270 |
| 4,895,506 | 1/1990 | Nonini et al. | 72/263 |
| 5,247,821 | 9/1993 | Bertoli | 72/270 |
| 5,335,528 | 8/1994 | Cristiani | 72/270 |

*Primary Examiner*—Lowell A. Larson
*Assistant Examiner*—Ed Tolan
*Attorney, Agent, or Firm*—Cohen, Pontani, Lieberman, Pavane

[57] ABSTRACT

A work method for loading an extrusion billet using a billet loader into the billet chamber of a metal extrusion press and a metal extrusion press for extruding sections through a die using an extrusion ram. Whereby the loading can be carried out regardless of the position of the billet chamber and the movement upon the removal of the extrusion residue. The metal extrusion press has a billet loading device coupled to the billet chamber and movable jointly with it in and opposite to the extrusion direction. The extrusion ram can be positioned spaced from the billet chamber by at least the length of an extrusion billet.

1 Claim, 3 Drawing Sheets

WORKING METHOD FOR LOADING AN EXTRUSION BILLET AND METAL EXTRUSION PRESS

BACKGROUND OF THE INVENTION

The present invention relates to a work method for loading an extrusion billet by means of a billet loader into the billet chamber of a metal extrusion press. The invention further relates to a metal extrusion press for extruding shaped sections through a die by means of an extrusion ram.

DESCRIPTION OF THE PRIOR ART

Metal extrusion presses for the production of shaped sections are known, being described, for instance, in the prospectus of Mannesmann Demag Hüttentechnik entitled: "Extrusion press for aluminum sections with controlled prestressed press frame". These known metal extrusion presses have a die, arranged fixed in a machine frame, which has the cross section of the shape to be extruded, as well as a billet loader, also mounted fixed on the machine frame. A billet chamber is provided between the die and the billet loader. The billet loader can be swung from a position alongside the machine frame into a loading position in which the extrusion billet which has been moved up can be inserted into an billet chamber. This is done by means of the extrusion ram, fastened to a ram cross member, which, with the billet loader swung inward, pushes the extrusion billet into the billet chamber and, upon the further working stroke, with the billet chamber resting against the die, presses the metal through the die.

For the removal of the extrusion residue, it is necessary and customary in known metal extrusion presses to move the billet chamber back from the die in order to provide between the two of them a distance which is necessary for cutting off the extrusion residue with extrusion residue shears. During the backward movement of the billet chamber, the billet loader is positioned in the rearward swung position so that the billet chamber can pass through this region unimpeded. After the removal of the extrusion residue, the billet chamber is moved back towards the die into its starting position, whereupon the billet loader is swung in with a new extrusion billet and the press is again loaded by filling the billet chamber.

The known machines have the disadvantage that the loading process for a new extrusion billet can only start when the billet chamber is in the so-called applied position, directly in front of the die. Since the productivity of a metal extrusion press is dependent essentially on the non-productive times of the press, and therefore the positioning times of the units, the removal of the extrusion residue, the loading of new extrusion billets, etc., a shortening of the non-productive time would result directly in an increase in production.

From EP-A-04 86 436, a billet loading device for a metal extrusion press is known in which the billet chamber at the extrusion end moves opposite the extrusion direction to a distance from the die and the extrusion ram simultaneously moves out of the billet chamber. The extrusion residue is then sheared off from the die.

For the insertion of a new billet, the ram in this device is moved transversely into a position to the side of the extrusion axis. A separate driven push rod is then provided for the insertion of the billet.

Another billet loading device is known from U.S. Pat. No. 2,919,039. In that case, the billet loader is arranged within the press directly on the billet chamber holder and is provided with a push-in lever which pushes the billet into the billet chamber. The extrusion ram can be moved only when the loader is swung out.

Proceeding herefrom, the purpose of the present invention is to provide a work method for the rapid loading of a metal extrusion press as well as a metal extrusion press for carrying out this work method with which the total non-productive time is considerably reduced.

The work method of the invention by which this object can be achieved includes the following steps:

a) at the extrusion end, the billet chamber moves opposite the direction of extrusion to a distance from the die;

b) at the same time, the extrusion ram moves out of the billet chamber;

c) the extrusion residue is cut off in the die;

d) at the same time as method steps a) to c), the billet loader which is positioned to the side of the extrusion line is moved, together with a new extrusion billet in direction opposite the extrusion direction and at the same time in the direction towards the extrusion ram;

e) as soon as a sufficient distance has been reached between extrusion ram and billet chamber, the two are stopped and the billet loader with the extrusion billet is moved into the loading position;

f) the extrusion ram is advanced in the direction of extrusion and pushes the extrusion billet into the billet chamber;

g) the billet loader moves back into its starting position as soon as the center of gravity of the longitudinal axis of the billet lies in the billet chamber; and h) billet chamber, billet loader and extrusion ram move together in an extruding position against the die, after the shearing process in front of the die has been completed.

The particular advantage of the work method of the invention is that the loading process can be carried our regardless of the position of the billet chamber and regardless of the course of movement upon the removal of the extrusion residue, so that the total non-productive times are considerably reduced by simultaneous positioning of individual apparatus parts.

A metal extrusion press the carrying out the work method of the invention, includes a die, a billet chamber for the extrusion billet, a billet loading device, an extrusion ram and a shearing device for the extrusion residue. The billet loading device, coupled to the billet chamber and jointly with it, can be moved in as well as opposite the extrusion direction. Additionally, the extrusion ram can be positioned to be spaced from the billet chamber by at least the length of an extrusion billet.

By the joint movement of billet loading device and billet chamber, it is possible to move the billet loader in the direction of its loading position already while the billet chamber is moved back in order to create the free space between it and the die. As soon as the extrusion ram has reached the required distance from the billet chamber, the billet loading device can be moved in and swung into position in order to bring a new extrusion billet into loading position.

Convention electric and/or electronic displacement recording systems are preferably provided for monitoring the position of the extrusion ram and the billet chamber. The entire course of the control of the press is controlled automatically in customary fashion in the manner that the movements are stored in a computer.

With a suitable development of the movements, the result is obtained that the shearing process of the extrusion residue and the billet loading process are completed almost simultaneously. A considerable reduction in the non-productive time is the result of this, and thus an increase in the total productivity of the installation.

DETAILED DESCRIPTION OF THE PREFERRED EMBODIMENT

In five methods steps, respectively shown in FIGS. 1–5 the positioning of the individual parts of the apparatus can be noted, in each case in a view of a greatly simplified metal extrusion press. The right-most-portion of each figure diagrammatically shows a cross section in the region of the billet loader.

The parts of the apparatus are designated as follows:
Billet loader 1
Billet chamber 2
Extrusion ram 3
Die 4
Extrusion billet 5

Figure 1B:
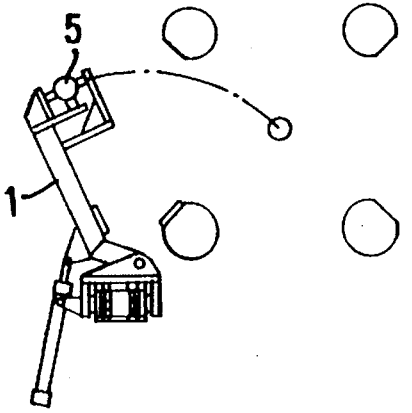
FIGS. 1–5 show the steps of the inventive method using a diagrammatically illustrated metal extrusion press.
Figure 2B:
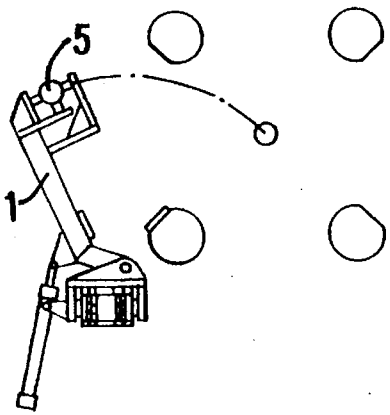
Figure 1A:
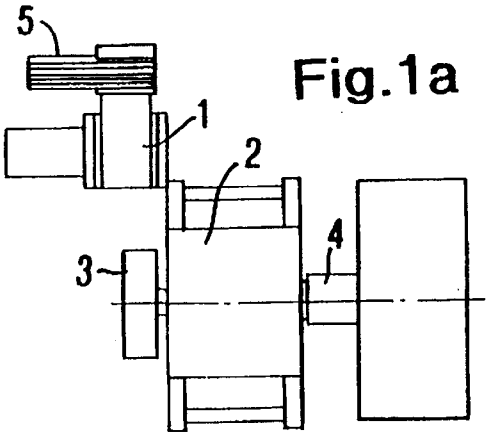

In FIGS. 1*a* and 1*b*, the billet loader 1 is swung out into a waiting position, and therefore displaced laterally to the billet chamber 2. By means of an external pushing device (not shown), an extrusion billet 5 is pushed into the chamber of the billet loader 1.

At the extrusion end, the billet chamber 2 moves into a shearing position (FIGS. 2*a* and 2*b*), which creates a sufficiently large free space between the die 4 and the billet chamber 2 for the shearing process of the extrusion residue shear. At the same time, together with the billet chamber 2, the billet loader 1 which is fastened to it moves into a position retracted with respect to the die. While the billet chamber 2 and the billet loader 1 move, the extrusion ram 3 also travels into its retracted position out of the billet chamber 2.

Figure 3B:
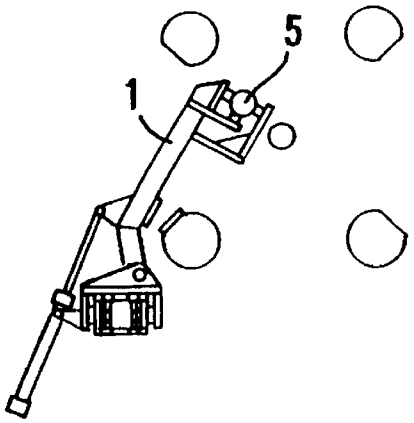
Figure 3A:
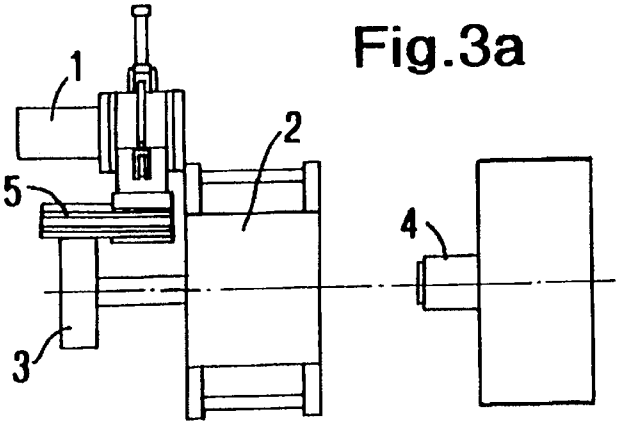

FIGS. 3*a* and 3*b* shows how the billet loader 1 is swung into an intermediate position while the extrusion ram 3 continues in its return travel out of the billet chamber 2. In this position, the extrusion billet 5 is already close to its loading position, while the shearing process of the extrusion residue still continues.

Figure 4B:
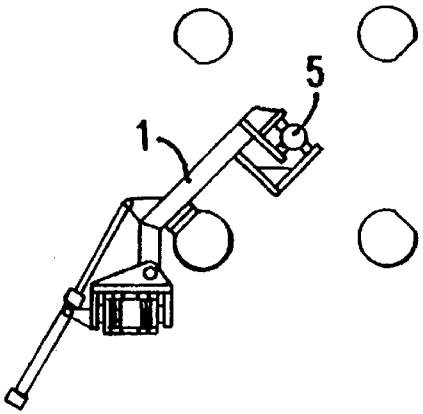
Figure 4A:
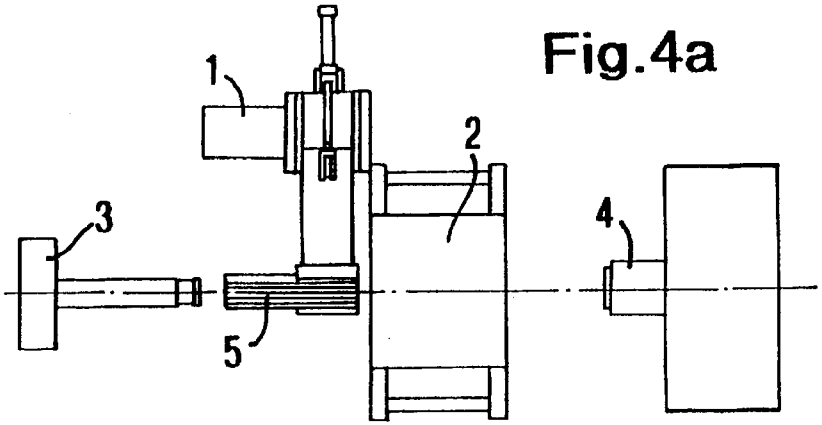

In FIGS. 4*a* and 4*b* the shearing process has not yet been completed while the extrusion ram 3 has arrived at its end position and the billet loader 1 is swung into the loading position. In this position, there is sufficient space for the inward swinging of the new extrusion billet 5 between the extrusion ram 3 and the billet chamber 2, while there is still room for the shearing of the extrusion residue between the billet chamber 2 and the die 4.

Figure 5B:
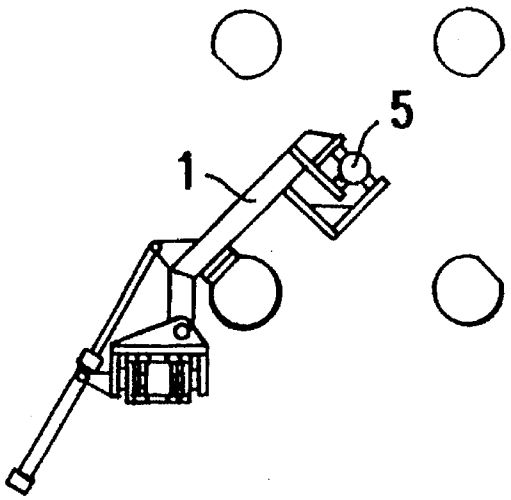
Figure 5A:
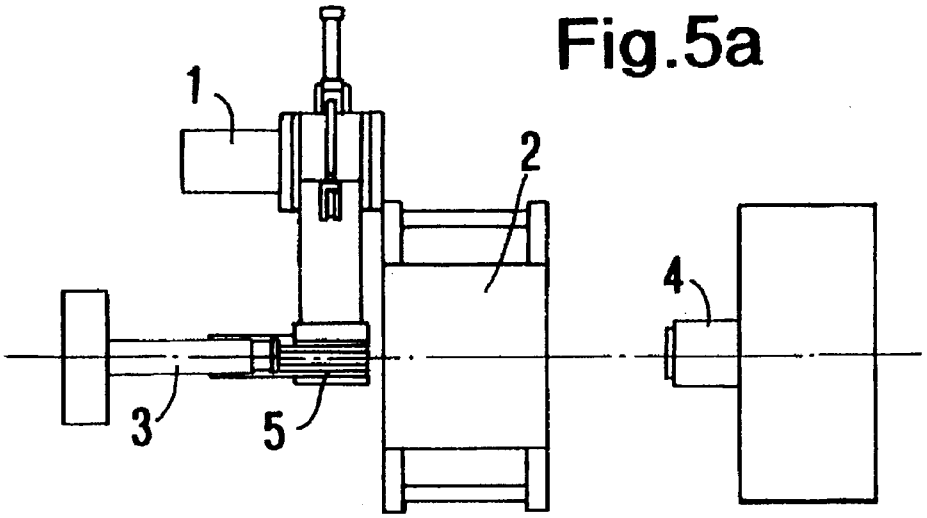

In FIGS. 5*a* and 5*b* the extrusion ram 3 is already placed in movement in the extrusion direction and pushes the extrusion billet 5 into the billet chamber 2. As soon as the center of gravity of the longitudinal axis of the extrusion billet 5 lies in the billet chamber 2, the billet loader 1 swings back into its starting position and the extrusion ram 3 moves the billet 5 further into the billet chamber 2, while the latter and the ram move together towards the die 4. As soon as the die 4 comes against the billet chamber, a new extrusion process commences. As soon as it is completed, the work cycle starts over again.

Figure 2A:
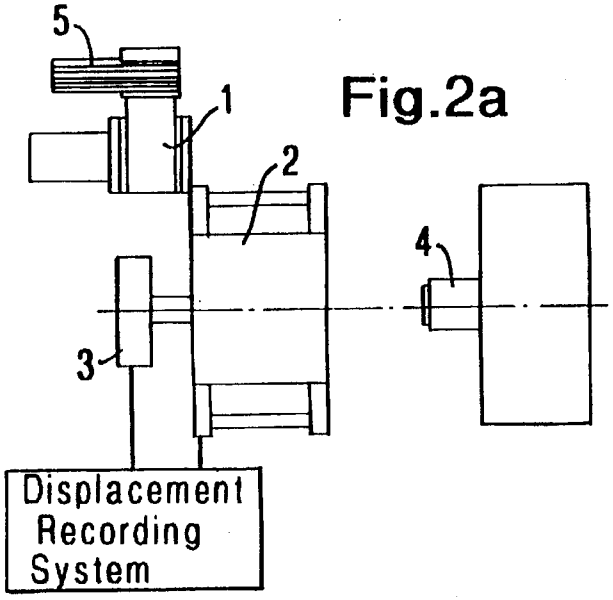

A conventionally known electric or electronic recording system monitors the position of the extrusion ram and the billet chamber, as schematically shown in FIG. 2*a*.

I claim:

1. A work method for loading an extrusion billet, using a single billet loader, into a single billet chamber of a metal extrusion press for extruding sectional shapes through a die with an extrusion ram, the method comprising the steps of:

a) moving the billet chamber, upon completion of an extrusion, in a direction opposite an extrusion direction to a distance from the die;

b) simultaneously moving the extrusion ram out of the billet chamber;

c) shearing off extrusion residue in front of the die;

d) simultaneously with steps a)–c), moving the billet loader, together with a new extrusion billet, in a direction opposite the extrusion direction and simultaneously therewith in a direction toward the extrusion ram;

e) stopping movement of the extrusion ram and the billet chamber when a specific distance between them has been reached and moving the billet loader with the extrusion billet into a loading position radial to the extrusion ram axis;

f) advancing the extrusion ram in the extrusion direction to push the new extrusion billet into the billet chamber;

g) radially moving the billet loader back into a starting position as soon as a center of gravity of a longitudinal axis of the billet lies in the billet chamber; and h) moving the billet chamber, the billet loader, and the extrusion ram together in an extrusion position against the die, after the shearing step is completed.

* * * * *